US005243772A

United States Patent [19]

Francis et al.

[11] Patent Number: 5,243,772

[45] Date of Patent: Sep. 14, 1993

[54] SHOE WITH EXTERNAL SHELL

[75] Inventors: Stephen A. Francis, Newburyport; Eric Swartz, Malden, both of Mass.

[73] Assignee: Converse Inc., North Reading, Mass.

[21] Appl. No.: 852,914

[22] Filed: Mar. 13, 1992

Related U.S. Application Data

[63] Continuation of Ser. No. 609,524, Oct. 31, 1990.

[51] Int. Cl.[5] ..... A43B 5/00; A43B 21/00

[52] U.S. Cl. ..... 36/114; 36/3 R; 36/45; 36/106; 36/89

[58] Field of Search ..... 36/1, 83, 88, 99, 102, 36/105, 106, 113, 114, 132, 136, 3 R, 3 A, 9 R, 25 R, 45, 50.1, 69, 117, 89

[56] References Cited

U.S. PATENT DOCUMENTS

| | | | |
|---|---|---|---|
| D. 47,238 | 4/1915 | Miller | 36/45 X |
| 1,247,467 | 11/1917 | Strauss | 36/3 A |
| 1,803,554 | 5/1931 | Knilans | 36/114 |
| 2,147,197 | 4/1939 | Glidden | 36/9 R |
| 3,939,582 | 2/1976 | Garbuio | 36/117 |
| 3,975,840 | 8/1976 | Juzenko | 36/117 |
| 4,132,016 | 1/1979 | Vaccari | 36/114 |
| 4,222,183 | 9/1980 | Haddox | 36/45 X |
| 4,384,413 | 5/1983 | Bourque | 36/115 |
| 4,425,721 | 1/1984 | Spronken | 36/132 X |
| 4,535,554 | 8/1985 | De Obaldia | 36/102 X |
| 4,972,613 | 11/1990 | Loveder | 36/50.1 X |
| 5,086,576 | 2/1992 | Lamson | 36/131 |

FOREIGN PATENT DOCUMENTS

| | | | |
|---|---|---|---|
| 0046251 | 2/1982 | European Pat. Off. | 36/115 |
| 7803481 | 10/1978 | Netherlands | 36/3 R |
| 2406 | of 1884 | United Kingdom | 36/3 A |
| 27107 | of 1897 | United Kingdom | 36/45 |
| 4010 | of 1909 | United Kingdom | 36/3 A |

*Primary Examiner*—Jimmy G. Foster
*Assistant Examiner*—Beth Anne C. Cicconi
*Attorney, Agent, or Firm*—Bromberg & Sunstein

[57] ABSTRACT

A shoe is provided comprising a sole, a sock attached to the sole, and a form-retaining shell attached to the sole, at least partially enclosing the sock, and not attached to the sock above the region of the sole, such that the sole may flex in use. The shell, an ankle restraint fastener and a heelband provide ankle support.

7 Claims, 11 Drawing Sheets

SHOE WITH EXTERNAL SHELL

This is a continuation of copending application Ser. No. 07/609,524 filed on Oct. 31, 1990.

TECHNICAL FIELD

The invention relates generally to shoes, and more specifically to protective sport shoes.

BACKGROUND OF THE INVENTION

Sport shoes for general use should, among other things, be light in weight, protect the foot from impacts from above, allow the sole to flex, and provide ankle support. A ski boot provides ankle support and impact protection but does not allow the sole to flex. A sandal allows the sole to flex but it does not provide any impact protection or ankle support. A basketball shoe allows the sole to flex and may provide ankle support but does not provide substantial impact protection.

French Patent No. 2,484,215 discloses a sports shoe having an upper made of intersecting bands of molded plastic material disposed outside of a sock. The sole is made of supple material, and the upper and sole are formed together in a mold, with the upper being molded onto the sock.

U.S. Pat. No. 1,803,544 discloses an athletic shoe having a sock-like upper which is removeably attached to a sole having side flanges and a toe cap.

U.S. Pat. No. 4,132,016 discloses a shoe with an upper comprising a shell made in one piece from wear-resistant material, such as plastics. Inside the shell is provided a liner having the form of a folded elongated strip to protect the wearer's foot.

SUMMARY OF THE INVENTION

In one embodiment, the invention provides a shoe having a sole, a sock attached to the sole, and a form-retaining shell, at least partially enclosing the sock, attached to the sole and not attached to the sock above the region of the sole. In a preferred embodiment, the shoe surrounds the foot with a lightweight, protective shell. A rear portion of the shell attached to the sole extends around the back of the foot and above and forward of the ankle. The rear portion may move longitudinally with respect to the medial and lateral portions of the shell as the sole flexes in use. A medial cantilever torsion bar portion of the shell, a lateral control strut portion of the shell, an ankle restraint fastener and a heelband provide ankle support.

DESCRIPTION OF SPECIFIC EMBODIMENTS

The shoe of the present invention at least partially surrounds the foot with a single-part or multi-part external lightweight protective shell. The shell is form-retaining and in some embodiments may be substantially rigid while still being somewhat resilient. The shoe includes a sock that is attached to the sole. The shell is attached to the sole in such a manner that the sole may flex in use. In a preferred embodiment the shell is attached to the sock but only in the region of the sole: the shell is not attached to the sock above the region of the sole.

Figure 1A:
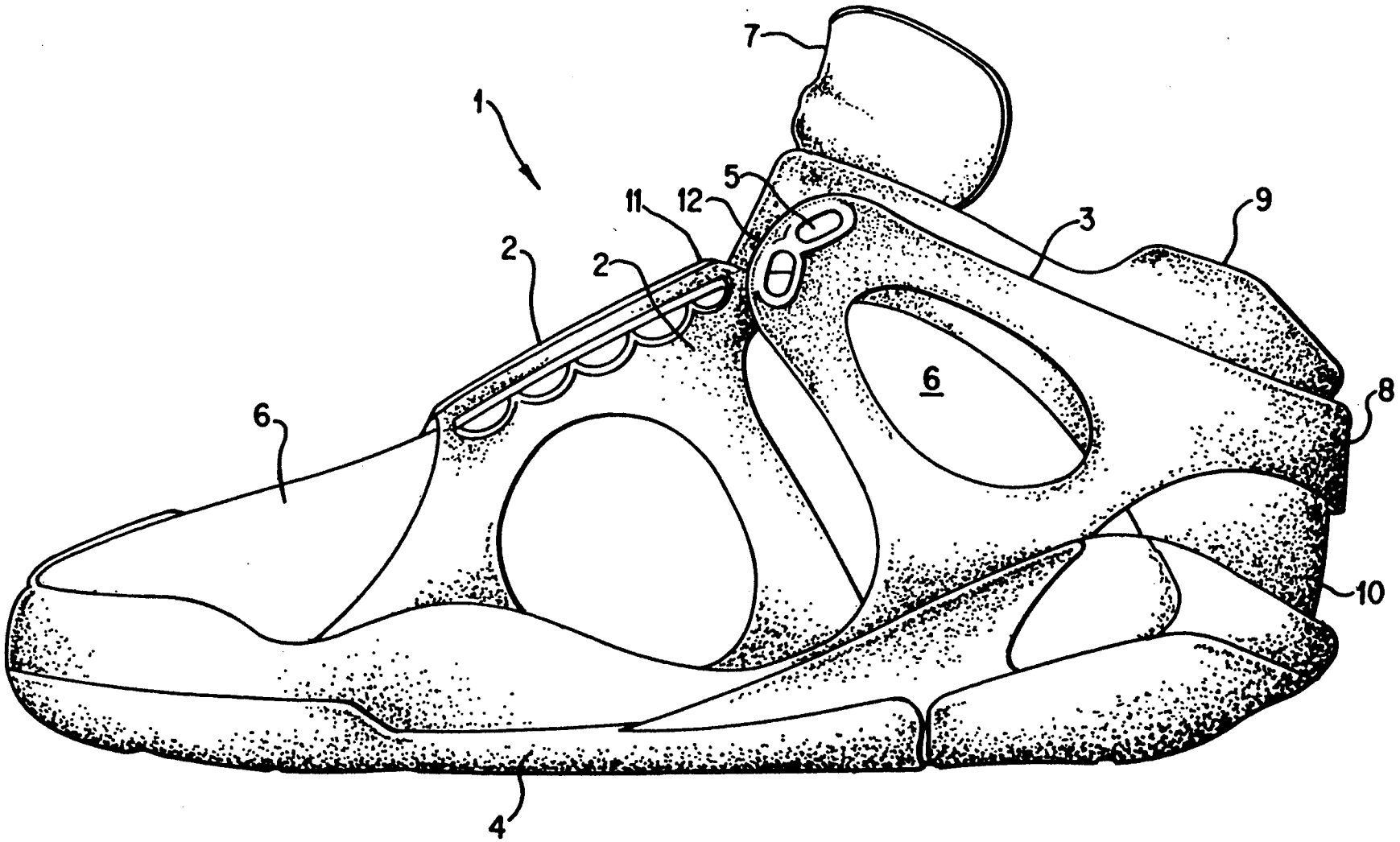
FIG. 1A is a partially cut away perspective view of a first embodiment of a shoe according to the present invention.
Figure 2:
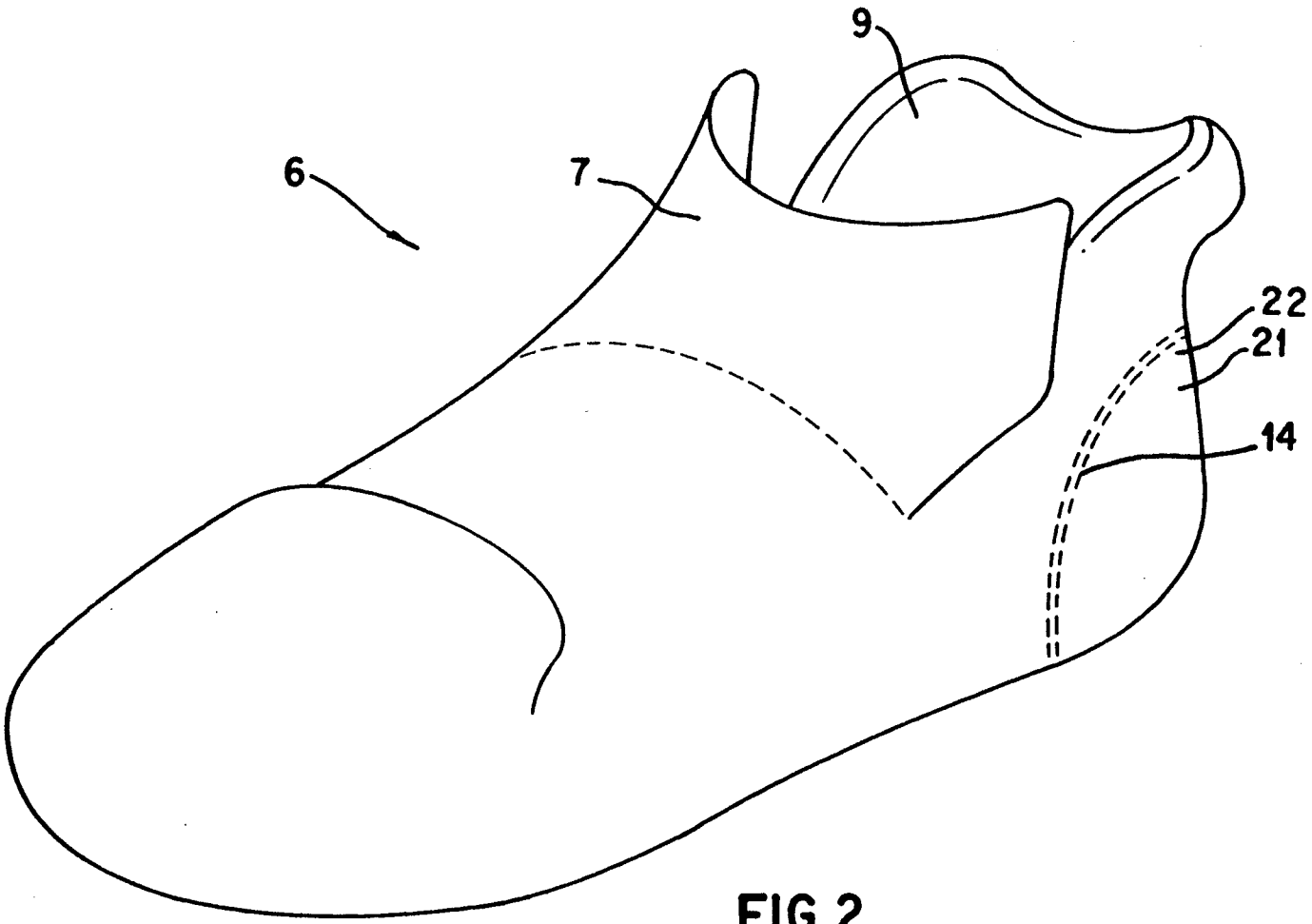
FIG. 2 is a perspective view of a sock according to the present invention.

A shoe according to a first embodiment of the present invention is shown in FIG. 1A. The shoe includes a shell main portion (1, 2 and 10), a shell rear portion (3), a sole (4), and a sock (6). The shell includes two separate pieces. The shell main portion includes a pair of form-retaining forefoot portions (2) that may be attached over the forefoot and which together cover and protect the forefoot. The shell main portion also includes a heel-piece (10) which surrounds and protects the heel. The rear portion (3) includes a heelband (8). The uppermost edges (11) of the forefoot portions and the foremost edges (12) of the rear portion are proximate with one another in the region of the top of the forefoot and are capable of moving longitudinally with respect to each other as the sole flexes in use. The shell provides structural support and injury protection. Preferably, the shell parts are resilient and form-retaining. They are preferably made of a tough, spring-like, plastic material such as polyurethane or other elastomeric polymer molded in a desired shape, however, sheet materials may be used in some embodiments. The external shell may be transparent, translucent or opaque and may be covered with a suitable decorative material. The sock is relatively compliant in relation to the shell parts. The sock is shown in FIG. 2. It is preferably made of a stretchable, resilient material or a stretch synthetic fabric such as Lycra Spandex. It includes a padded tongue (7) and a padded collar (9). The sock may further include buffering material placed to protect the foot from the sharp edges of the shell. In some embodiments the sock may contain a counter (21) enclosed in a counter pocket (22) attached by stitching (14). Returning now to FIG. 1A, the rear portion of the shell of the first embodiment includes a heelband (8) that surrounds the heel-piece and supports the heel. The rear portion further includes eyelets (5) through which laces may be threaded and tightened to provide support for the ankle.

Figure 1C:
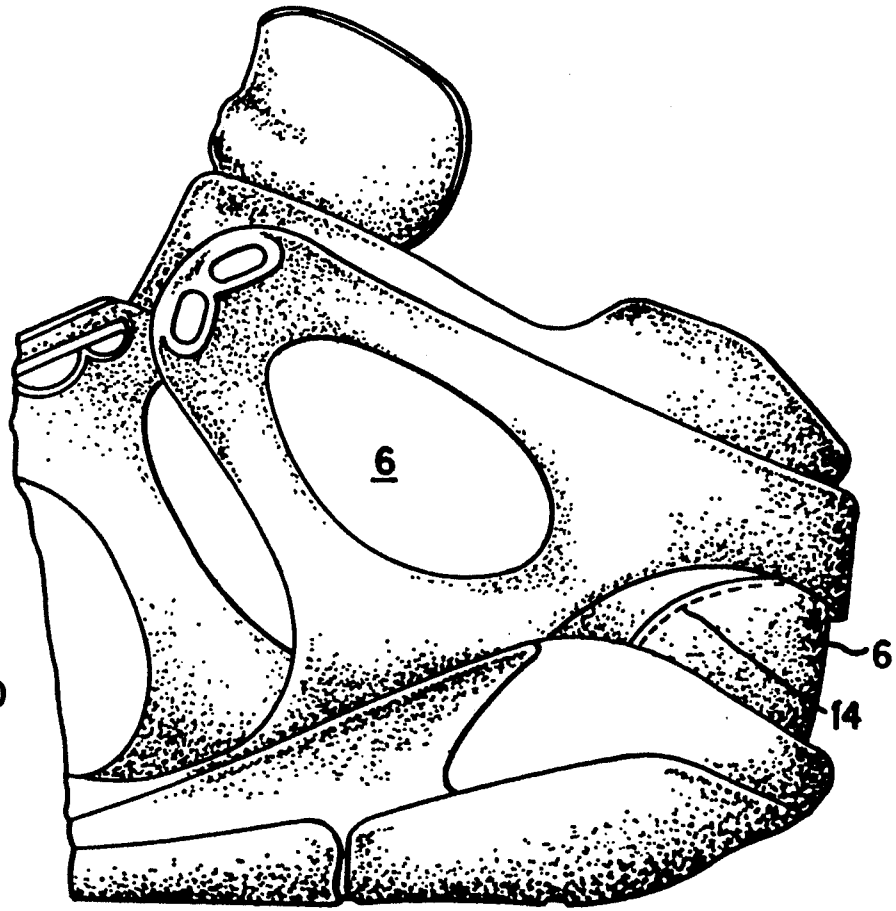
FIG. 1C is a partially cut away perspective view of a third embodiment of a shoe according to the present invention.
Figure 1B:
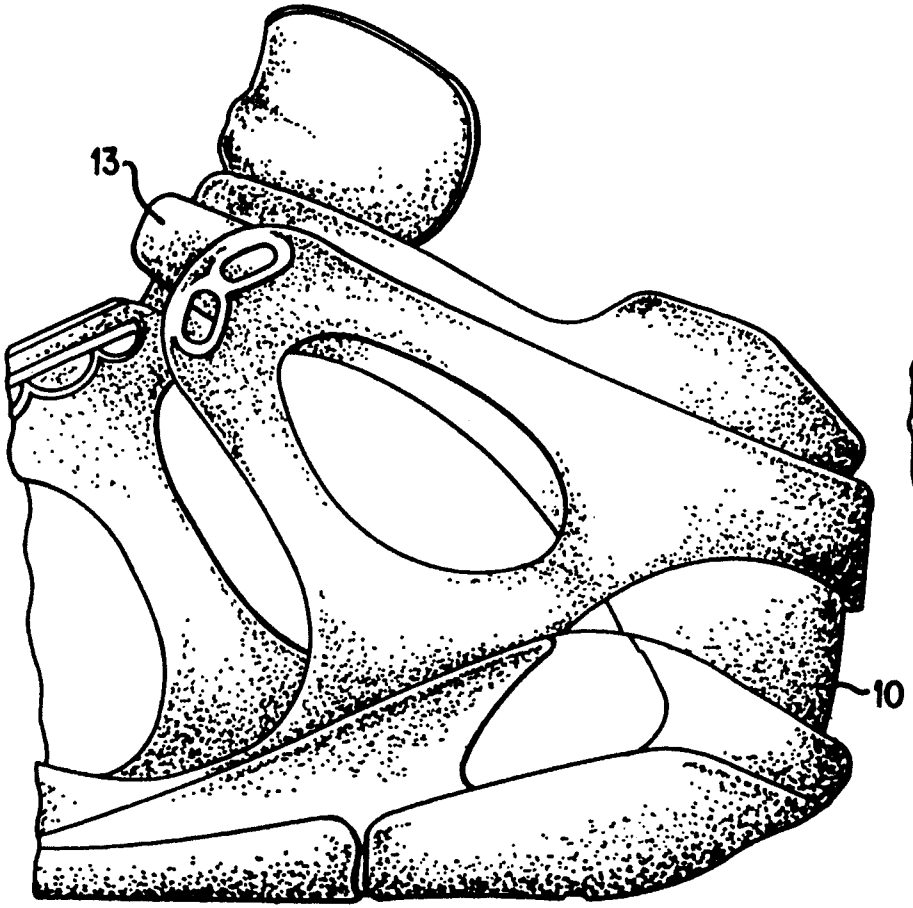
FIG. 1B is a partially cut away perspective view of a second embodiment of a shoe according to the present invention.

A second embodiment and a third embodiment are shown in FIGS. 1B and 1C respectively. In the embodiment shown in FIG. 1B, the shell consists of three separate pieces: a pair of form-retaining forefoot portions (2) and a heel-piece (10). Because the heel-piece of the shell is not joined to the fore portions, it may move longitudinally with respect to the fore portions as the sole flexes. In the third embodiment, shown in FIG. 1C, the separate heel-piece of second embodiment is omitted and the sock contains a counter to provide heel support.

Figure 3:
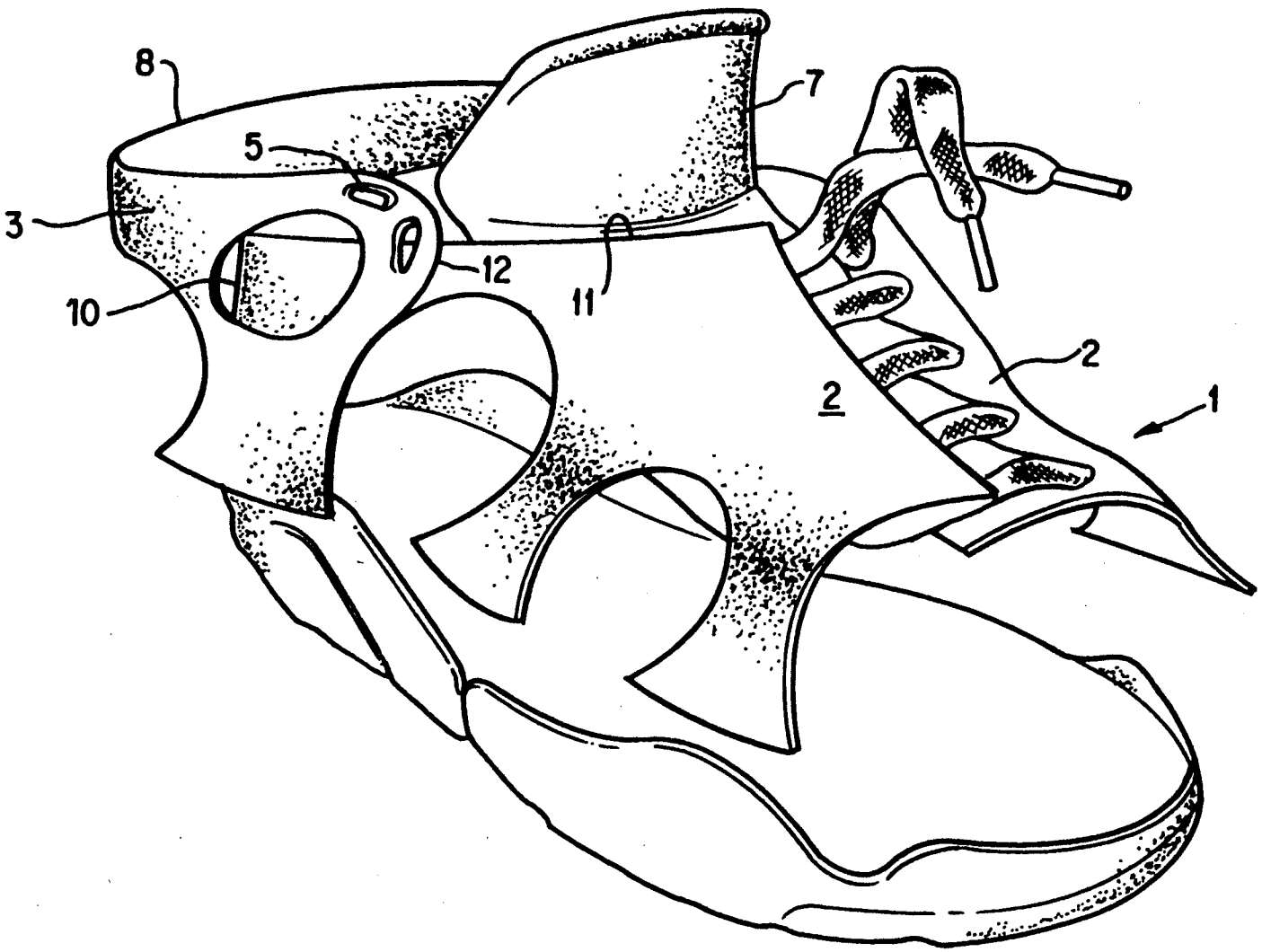
FIG. 3 is an exploded perspective view of a shoe of the embodiment shown in FIG. 1.
Figure 4:
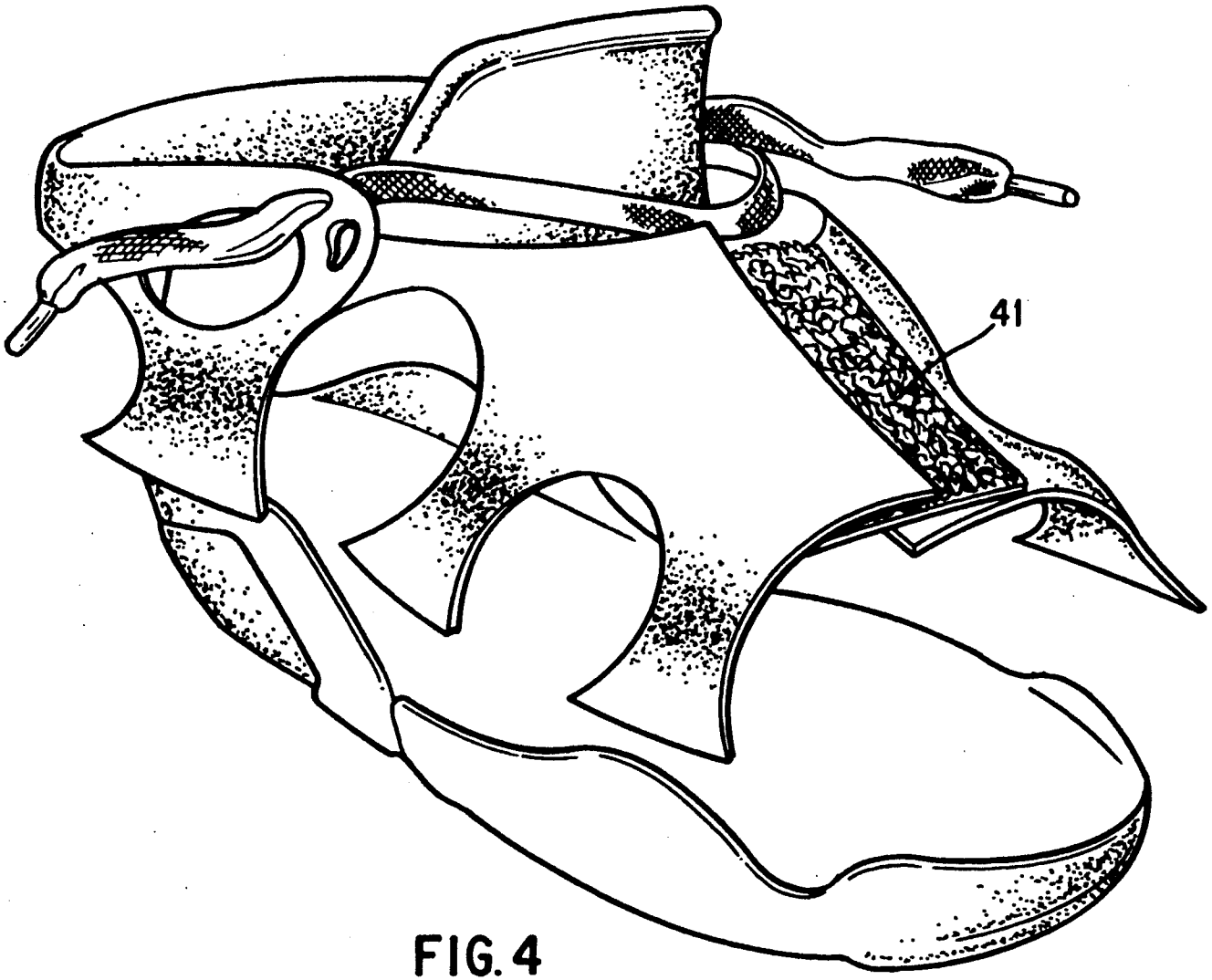
FIG. 4 is an exploded perspective view of a fourth embodiment of a shoe according to the present invention.

The lateral and medial forefoot portions (2) of the shell of the first three embodiments may be fastened together over the forefoot by means of laces, as shown in FIG. 3. In a fourth embodiment, shown in FIG. 4, the lateral and medial forefoot portions may be fastened together using a hook and pile fastener (41) such as sold under the VELCRO trademark. It can be seen that in these three embodiments, the sock may be removeably attached to the sole.

Figure 5A:
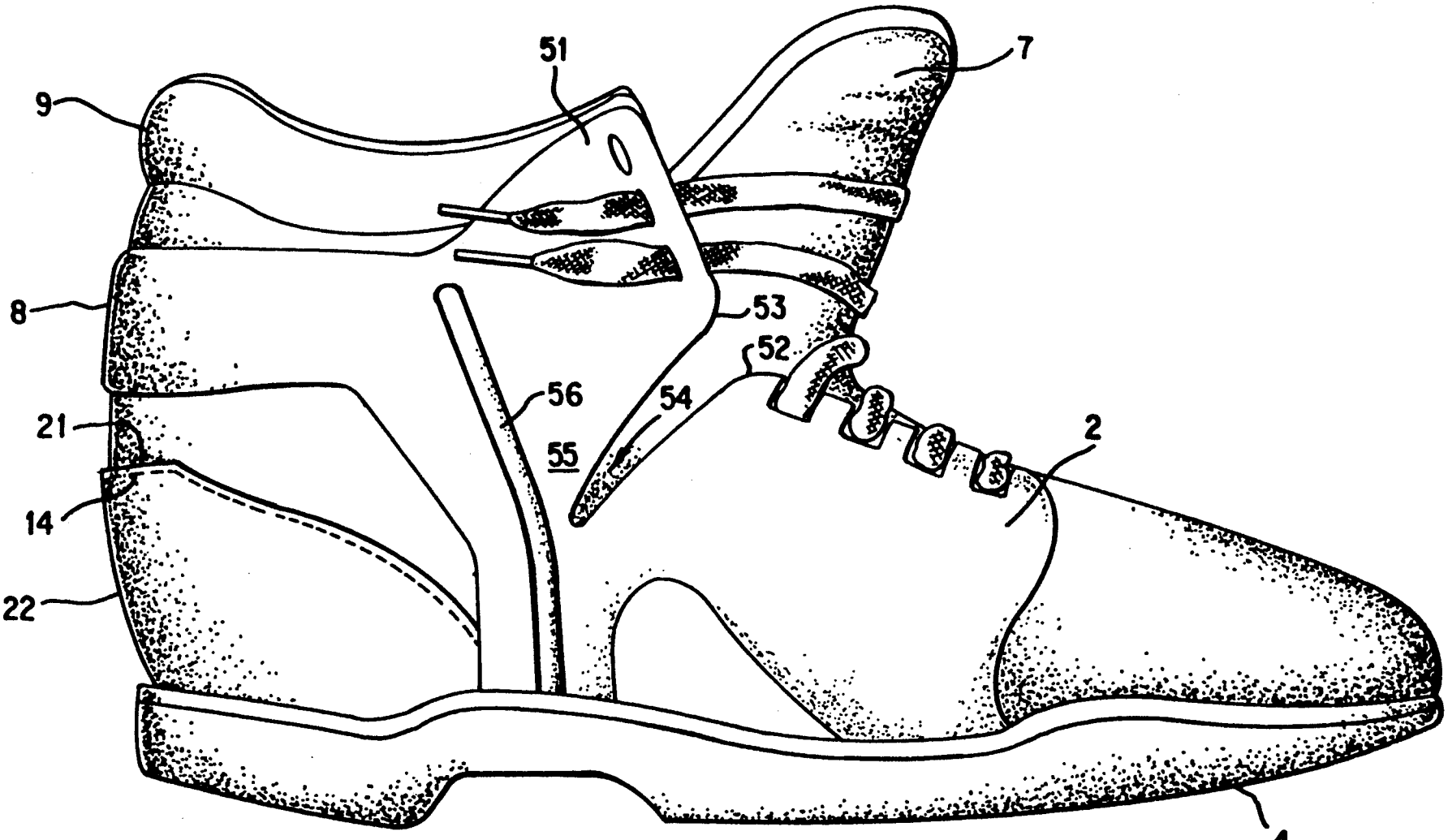
FIG. 5A is a perspective view of a fifth embodiment of a shoe according to the present invention.
Figure 6A:
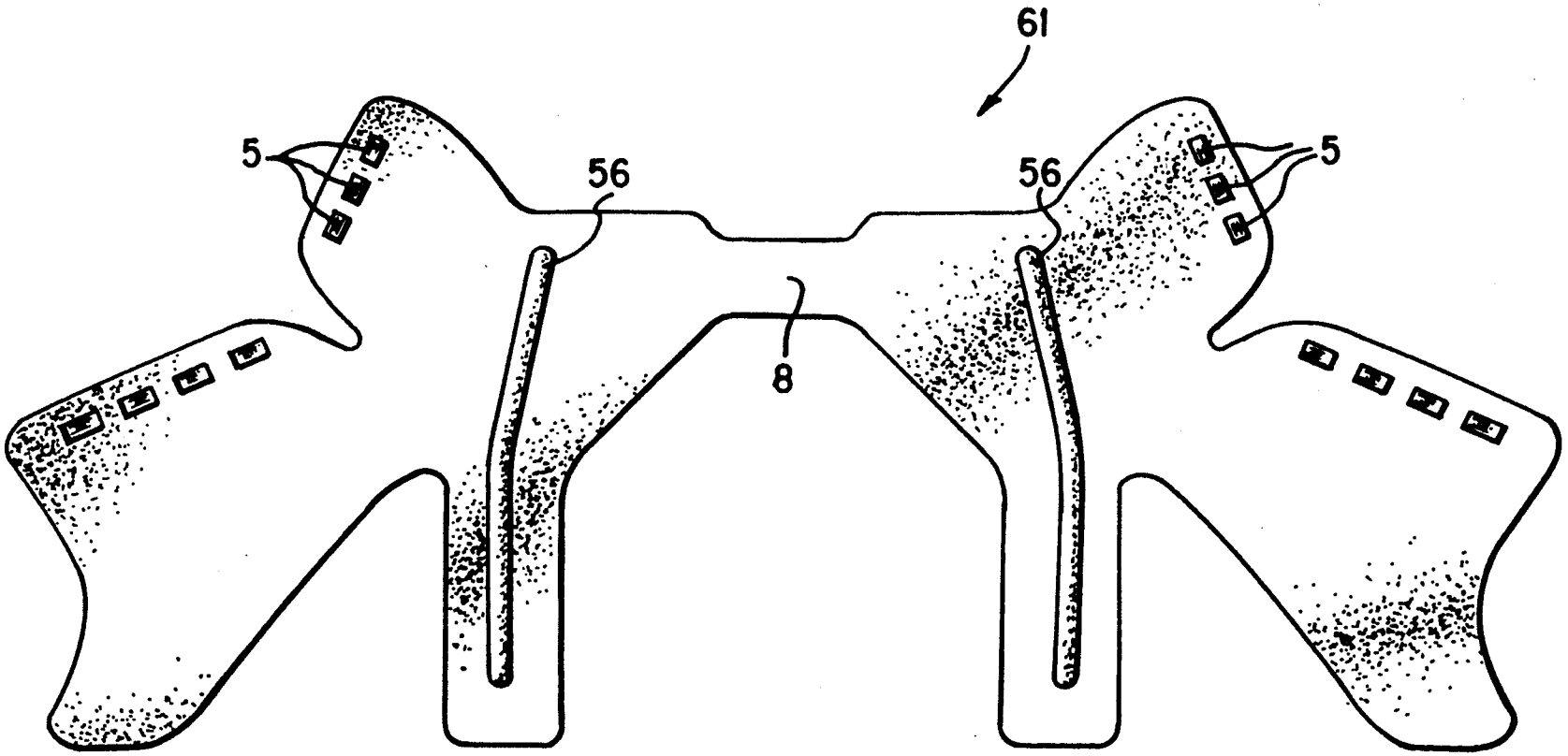
FIG. 6A is a plan view of the shell molding of the fifth embodiment.

A fifth embodiment, shown in FIG. 5A, uses a single-piece shell. The shell is preferably a molded plastic piece (61) as shown in plan view in FIG. 6A. Returning now to FIG. 5A, the shell of the fifth embodiment includes forefoot portions (2), uppermost portions (51), cantilever torsion bar portions (55), and a heelband (8). The sock contains a counter (21) enclosed in a counter pocket (22) attached by stitching (14). Padded collar (9) of the sock beneficially distributes forces from the edge of the shell over the heel area. The sock may further include buffering material placed to protect the foot from the sharp edges of the shell. The ability of the top edge (52) of the forefoot portions (2) of the shell to move longitudinally with respect to the forward edge (53) of the uppermost portions (51) of the shell is facilitated by notch (54). This enables the sole to flex in use in spite of the rigidity of the shell. Cantilever torsion bar stiffening braces (56) are provided in the molded plastic sheet to augment the rigidity of the cantilever torsion bar portion of the shell for improved ankle support.

Figure 5B:
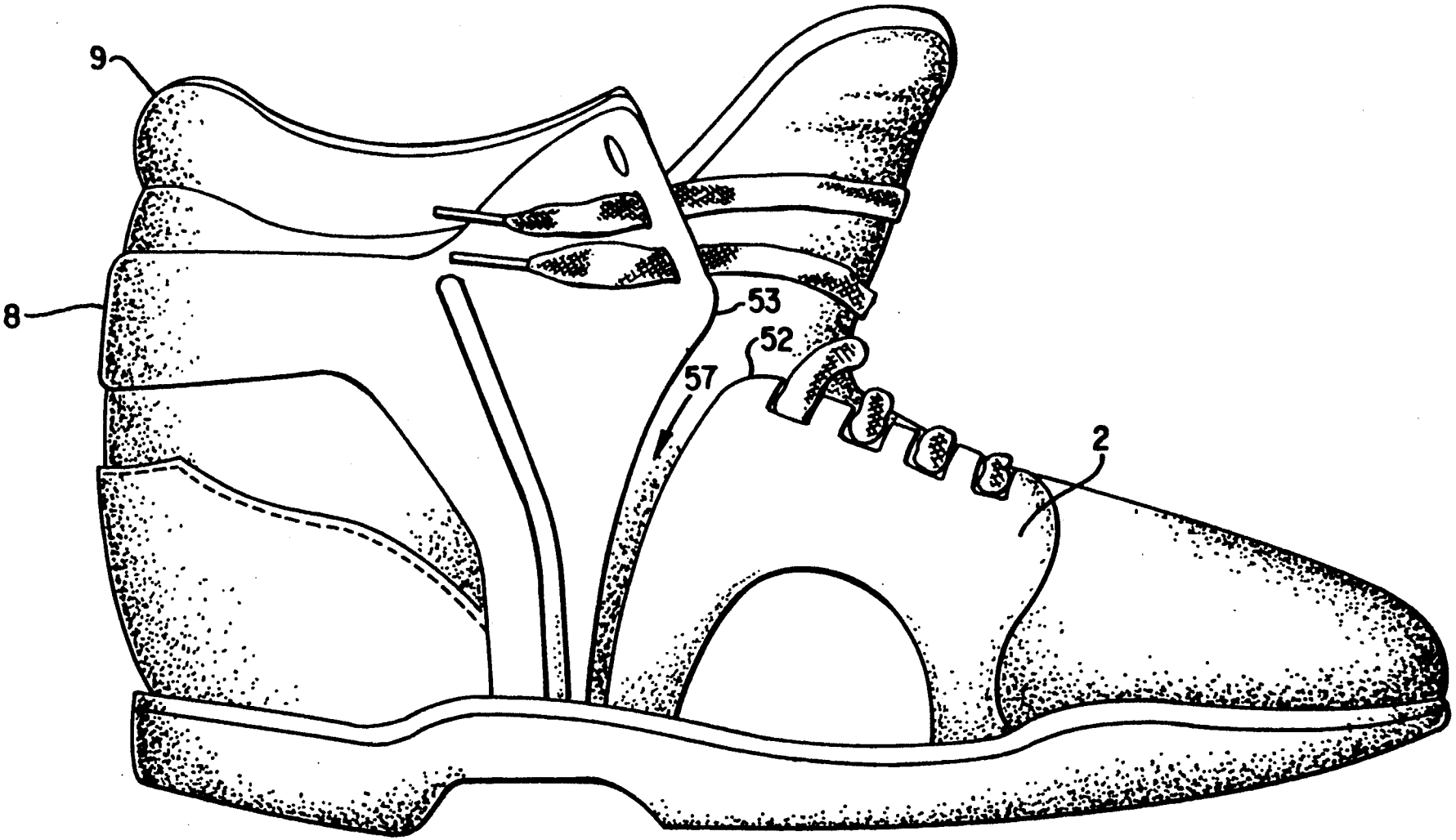
FIG. 5B is a perspective view of a seventh embodiment of a shoe according to the present invention.
Figure 5C:
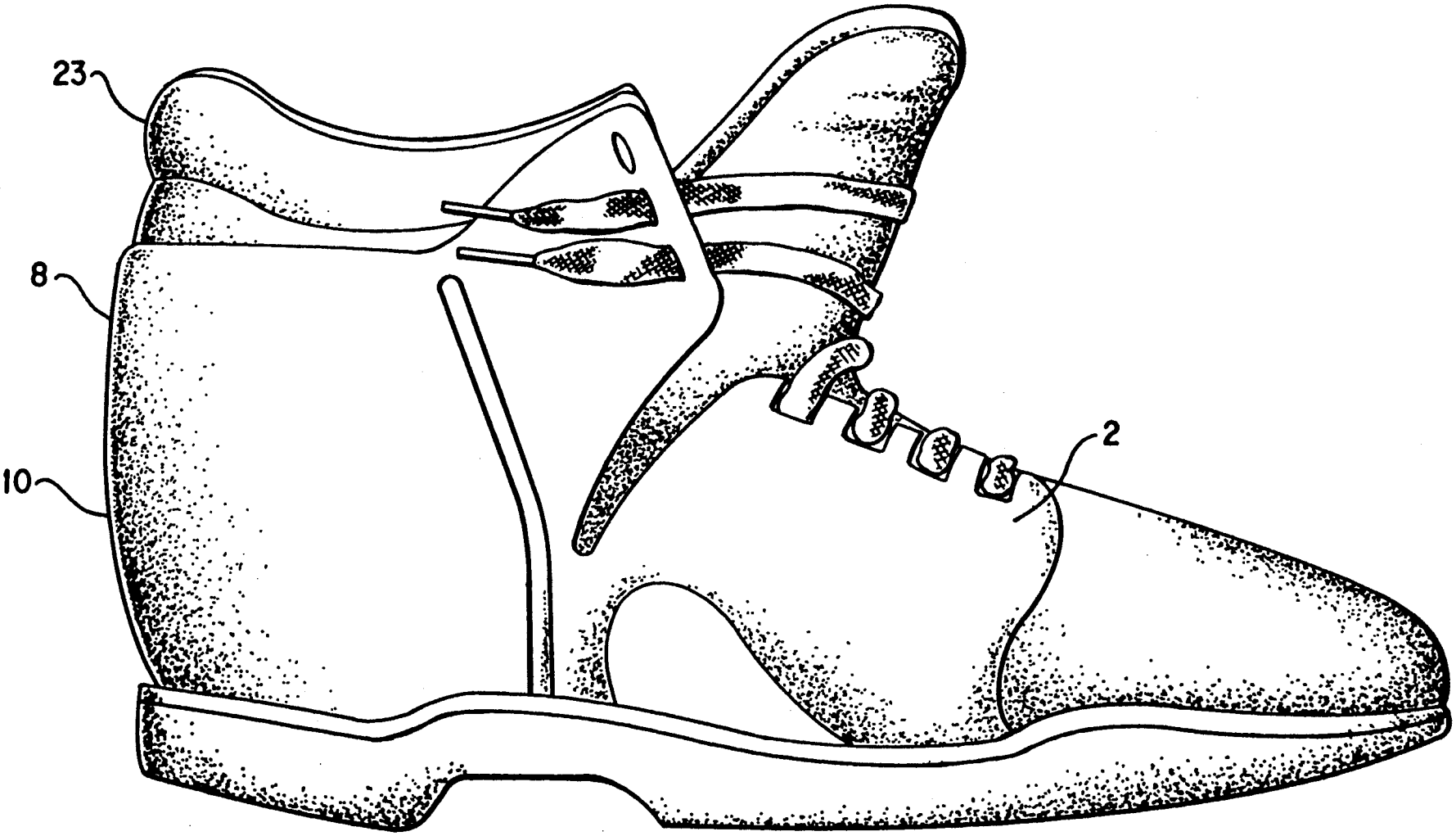
FIG. 5C is a perspective view of an eighth embodiment of a shoe according to the present invention.
Figure 5D:
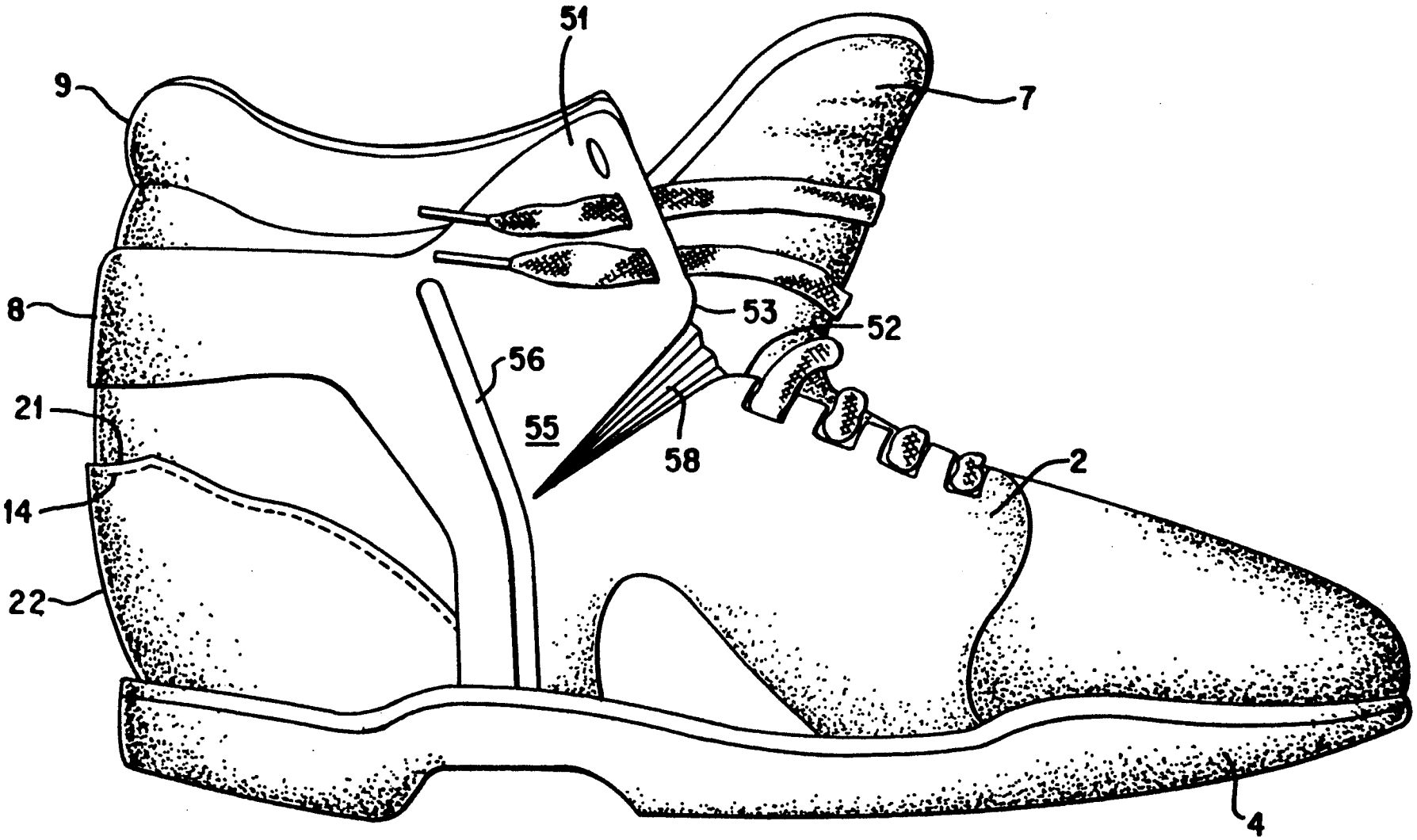
FIG. 5D is a perspective view of a shoe similar to that shown in FIG. 5A including a bellows structure.

In a sixth embodiment, the notch of FIG. 5A is partially or wholly replaced by a flexible "corrugated" or "bellows" portion 58 in FIG. 5D having a relatively thin, fan-like cross-section which may be molded into the shell.

A seventh embodiment, shown in FIG. 5B, uses a three-piece shell. In this embodiment, gap (57) serves the same purpose as the notch of the fifth embodiment.

Figure 6B:
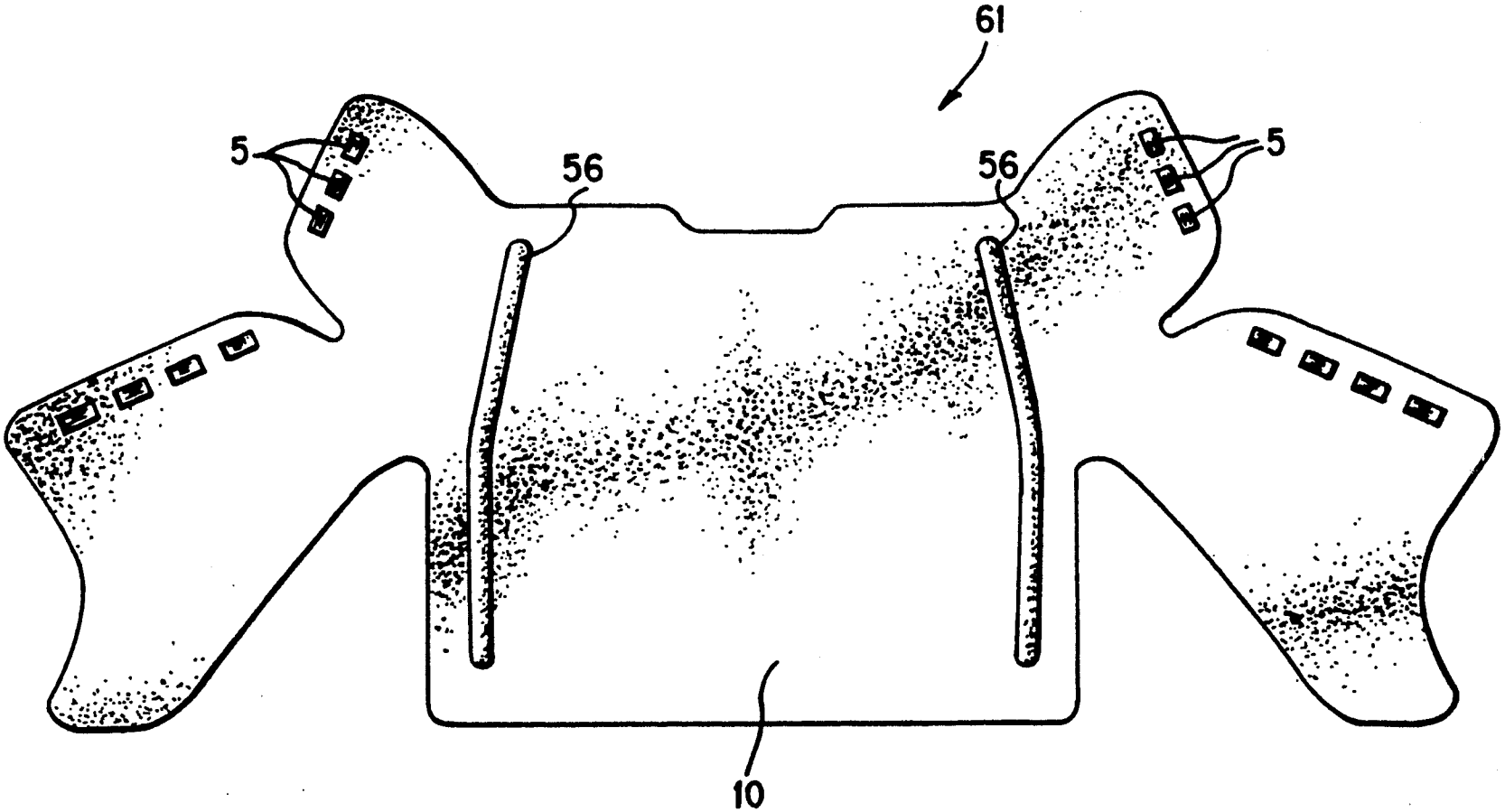
FIG. 6B is a plan view of the shell molding of the eighth embodiment.

In an eighth embodiment, shown in FIG. 5C, a one-piece shell includes a heel-piece portion (10). The corresponding shell molding is shown in FIG. 6B. In this embodiment, the sock need not contain a counter and no separate heelband is provided. Additional padding is provided between the heel-portion and the heel, preferably between the heel-portion and the sock.

What is claimed is:

1. A shoe comprising:

a sole;

a sock, attached to the sole;

a substantially rigid form-retaining shell, including (a) a medial forefoot portion, having a medial topmost edge, at least partially enclosing the sock in the region of the medial forefoot, (b) a lateral forefoot portion, having a lateral topmost edge, at least partially enclosing the sock in the region of the lateral forefoot, (c) a heel portion, including a medial heel portion having a medial forward edge located forward of the ankle and proximate to the medial topmost edge, and a lateral heel portion having a lateral forward edge located forward of the ankle and proximate to the lateral topmost edge, wherein the heel portion at least partially encloses the sock in the region of the heel, (d) a medial flexure portion between the medial heel portion and the medial forefoot portion, and (e) a lateral flexure portion between the lateral heel portion and the lateral forefoot portion, wherein the medial forefoot portion, the lateral forefoot portion, and the heel portion are each attached to the sole, and the medial and lateral flexure portions are shaped such that the medial topmost edge may move longitudinally with respect to the medial forward edge and the lateral topmost edge may move longitudinally with respect to the lateral forward edge as the sole flexes in use; and means for attaching the medial forefoot portion to the lateral forefoot portion across the top of the foot;

wherein the heel portion further includes:

a heelband portion;

a medial cantilever torsion bar portion substantially parallel to a vertical plane aligned with the direction of the foot, extending upward from the region of the sole proximate to the instep to a region forward of the ankle, the medial cantilever torsion bar portion having an attachment point proximate to the medial forward edge;

a lateral cantilever torsion bar portion substantially parallel to a vertical plane aligned with the direction of the foot, extending upward from the region of the sole proximate to the instep to a region forward of the ankle, the lateral cantilever torsion bar portion having an attachment point proximate to the lateral forward edge; and ankle restraint fastening means for fastening under tension the attachment points so as to form with the heelband portion a structure for inhibiting displacement of the ankle.

2. A shoe according to claim 1, wherein each cantilever torsion bar portion includes a stiffening portion.

3. A shoe according to claim 1, wherein each flexure portion includes a bellows structure.

4. A shoe according to claim 1, wherein the medial flexure portion includes a notch located between the medial heel portion and the medial forefoot portion, and the lateral flexure portion includes a notch located between the lateral heel portion and the lateral forefoot portion.

5. A shoe comprising:

a sole;

a sock, attached to the sole;

a substantially rigid form-retaining medial forefoot shell, attached to the sole, at least partially enclosing the sock in the region of the medial forefoot, having a medial topmost edge;

a substantially rigid form-retaining lateral forefoot shell, attached to the sole, at least partially enclosing the sock in the region of the lateral forefoot, having a lateral topmost edge;

a substantially rigid form-retaining heel shell, attached to the sole, at least partially enclosing the sock in the region of the heel, including (a) a heelband portion, (b) a medial heel shell portion having a medial forward edge located forward of the ankle and proximate to the medial topmost edge, (c) a lateral heel shell portion having a lateral forward edge located forward of the ankle and proximate to the lateral topmost edge, (d) a medial cantilever torsion bar portion substantially parallel to a vertical plane aligned with the direction of the foot, extending upward from the region of the sole proximate to the instep to a region of the ankle, the medial cantilever torsion bar portion having an attachment point proximate to the medial forward edge, and (e) a lateral cantilever torsion bar portion substantially parallel to a vertical plane aligned with the direction of the foot, extending upward from the region of the sole proximate to the instep to a region forward of the ankle, the lateral cantilever torsion bar portion having an attachment point proximate to the lateral forward edge;

means for attaching the medial forefoot shell to the lateral forefoot shell across the top of the foot; and ankle restraint fastening means for fastening under tension the attachment points so as to form with the heelband portion a structure for inhibiting displacement of the ankle.

6. A shoe comprising:

a sole;

a sock, attached to the sole;

a substantially rigid form-retaining shell, including a medial forefoot portion at least partially enclosing the sock in the region of the medial forefoot, a lateral forefoot portion at least partially enclosing the sock in the region of the lateral forefoot, and a heel portion at least partially enclosing the sock in the region of the heel, the medial forefoot portion, the lateral forefoot portion, and the heel portion each attached to the sole, the medial forefoot portion having a medial topmost edge, and the lateral forefoot portion having a lateral topmost edge;

means for attaching the medial forefoot portion to the lateral forefoot portion across the top of the foot;

a substantially rigid form-retaining heel shell, attached to the sole, at least partially enclosing the sock in the region of the heel, including (a) a heelband portion, (b) a medial heel shell portion having a medial forward edge located forward of the ankle and proximate to the medial topmost edge, (c) a lateral heel shell portion having a lateral forward edge located forward of the ankle and proximate to the lateral topmost edge, (d) a medial cantilever torsion bar portion substantially parallel to a vertical plane aligned with the direction of the foot, extending upward from the region of the sole proximate to the instep to a region of the ankle, the medial cantilever torsion bar portion having an attachment point proximate to the medial forward edge, and (e) a lateral cantilever torsion bar portion substantially parallel to a vertical plane aligned with the direction of the foot, extending upward from the region of the sole proximate to the instep to a region forward of the ankle, the lateral cantilever torsion bar portion having an attachment point proximate to the lateral forward edge; and ankle restraint fastening means for fastening under tension the attachment points so as to form with the heelband portion a structure for inhibiting displacement of the ankle.

7. A shoe according to claim 6, wherein each cantilever torsion bar portion includes a stiffening brace portion.

* * * * *